United States Patent [19]

Nelson

[11] Patent Number: 5,010,617

[45] Date of Patent: Apr. 30, 1991

[54] POLISHING MITTEN

[76] Inventor: Walter Nelson, 1936 Park St., Hartford, Conn. 06106

[21] Appl. No.: 309,438

[22] Filed: Feb. 13, 1989

[51] Int. Cl.[5] ..... A47L 23/10

[52] U.S. Cl. ..... 15/227; 2/158

[58] Field of Search ..... 15/227; 2/158, 159

[56] References Cited

U.S. PATENT DOCUMENTS

| | | | |
|---|---|---|---|
| 2,239,919 | 4/1941 | Lindfelt | 15/227 |
| 3,885,249 | 5/1975 | DeBrabander | 15/227 |
| 4,843,650 | 7/1989 | Kangas et al. | 2/159 |
| 4,843,652 | 7/1989 | Kuwahara | 2/159 |

FOREIGN PATENT DOCUMENTS

| | | | |
|---|---|---|---|
| 3590 | of 1909 | United Kingdom | 15/227 |

*Primary Examiner*—Edward L. Roberts

*Attorney, Agent, or Firm*—Robert S. Smith

[57] ABSTRACT

A polishing mitten apparatus for polishing a shoe or other associated object which includes a first web shaped fabric member having a portion thereof dimensioned and configured with an outline which is substantially the same as the outline of the palm and extended fingers of the intended user, a second web shaped fabric member having a portion thereof which is substantially the same size and shape as the first web shaped fabric member and further including an extension dimensioned and configured for extending over the wrist of the user, and a strap member fixed to the extension dimensioned and configured for encircling the wrist of the user. In some forms of the invention the first or second or both web shaped fabric members includes a plurality of layers, at least one of the plurality of layers is a non-woven absorbent material.

18 Claims, 2 Drawing Sheets

POLISHING MITTEN

BACKGROUND OF THE INVENTION

The invention relates to apparatus for polishing and particularly for polishing shoes. The prior art includes a wide variety of cloths and brushes which have been used for polishing shoes. Typically a separate brush has been used to apply polish, although some spit shines have been performed with a single cloth to apply both the polish and to shine the leather of the shoe.

The prior art includes U.S. Pat. No. 3,806,260. The structure described in this patent is intended for applying the polish by breaking very small capsules disposed near the face of the mitten and containing the polish. Then the reverse side of the mitten is used to polish the shoe. Such apparatus is in general too complex and costly and does not produce a superior shine.

It is an object of the invention to produce apparatus which will enable the user to produce a very superior shine on an associated shoe.

It is another object of the invention to provide apparatus which will be convenient for the user to utilize.

Still another object of the invention to provide apparatus which will enable the use to avoid soiling his hands while polishing shoes.

Yet another object of the invention is to provide apparatus which will be suitable for both applying shoe polish and on the same surfaces thereof be suitable for shining the associated shoe.

Another object of the invention is to provide a mitten for polishing shoes which will conform generally to the shape of the fingers and palm of the user and particularly to the shape of the outline of the fingers of a typical user.

A further object of the invention is to provide apparatus which is suitable for either the left or right hand of the user.

SUMMARY OF THE INVENTION

It has now been found that these and other objects of the invention may be attained in a polishing mitten which includes an a first web shaped fabric member having a portion thereof dimensioned and configured with an outline which is substantially the same as the outline of the palm and extended fingers of the intended user. A second web shaped fabric member has a portion thereof which is substantially the same size and shape as the first web shaped fabric member and further including an extension dimensioned and configured for extending over the wrist of the user. A strap member is fixed to the extension dimensioned and configured for encircling the wrist of the user.

This embodiment of the apparatus in accordance with the invention may further include the strap having first and second axial sections which are respectively cooperating hook and eye portions. The strap may have a ring fixed to one axial extremity thereof. The strap member may be fixed to the extension intermediate the first axial extremity and the first and second axial sections. The ring may be generally D-shaped and one side thereof may be substantially straight and that side is fixed to the first axial extremity of the strap member.

In another embodiment of the invention the first or second or both web shaped fabric members include a plurality of layers and at least one of the plurality of layers is a non-woven absorbent material.

BRIEF DESCRIPTION OF THE DRAWING

The invention will be better understood by reference to the accompanying drawing in which.

DESCRIPTION OF THE PREFERRED EMBODIMENT

Figure 2:
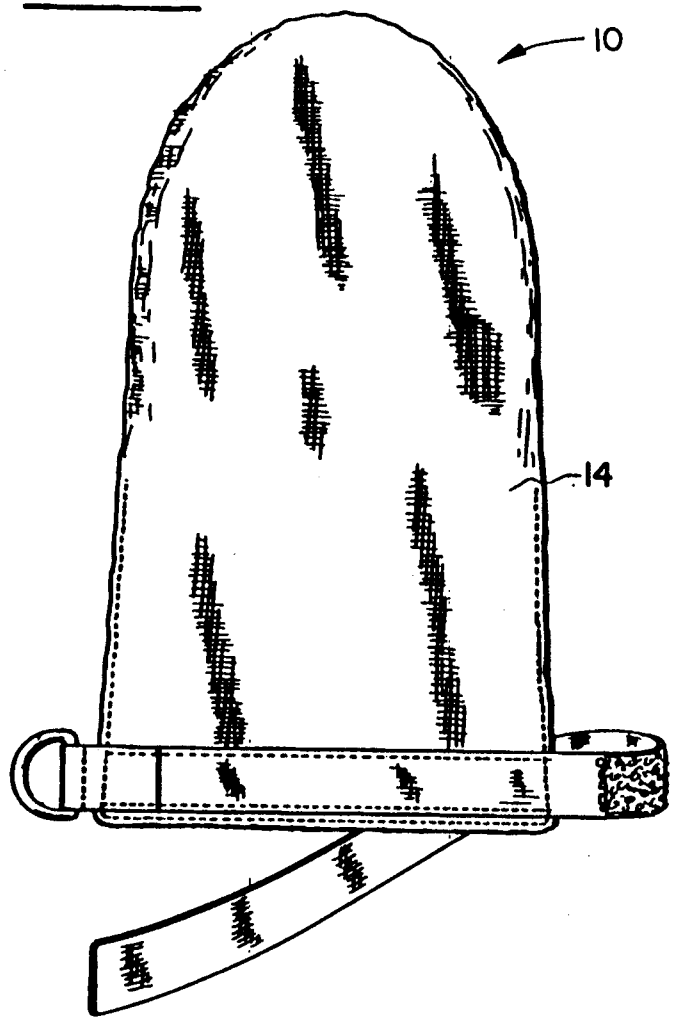
FIG. 2 is a bottom view of the appratus shown in FIG. 1.
Figure 1:
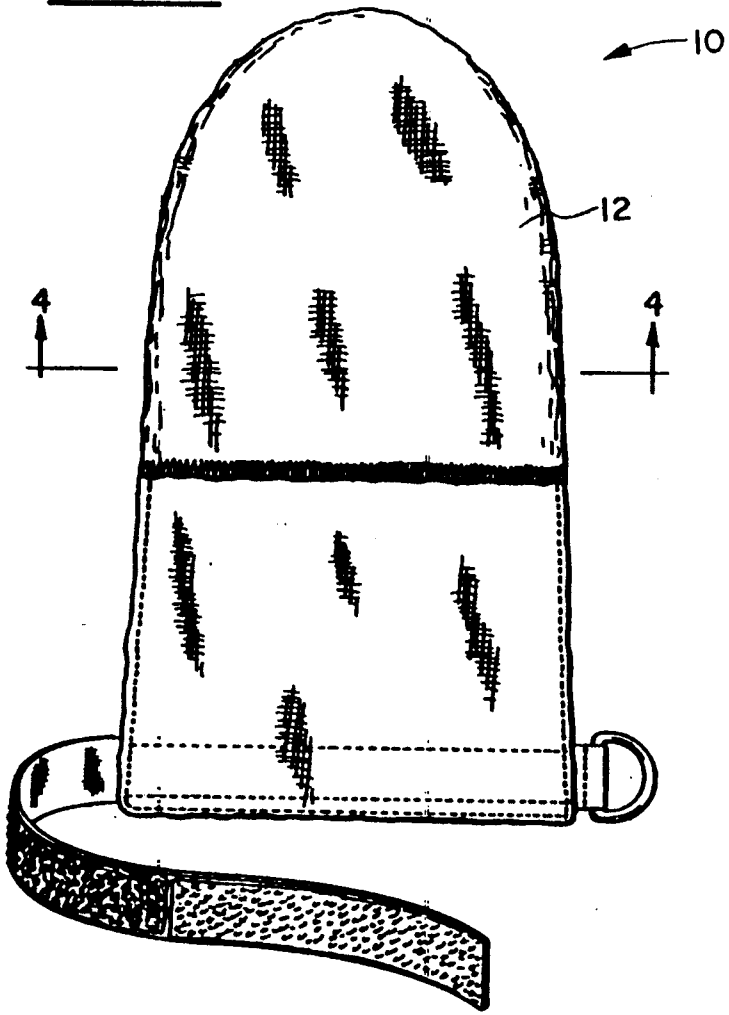
FIG. 1 is a top plan view of the apparatus in accordance with a one form of the invention.
Figure 3:
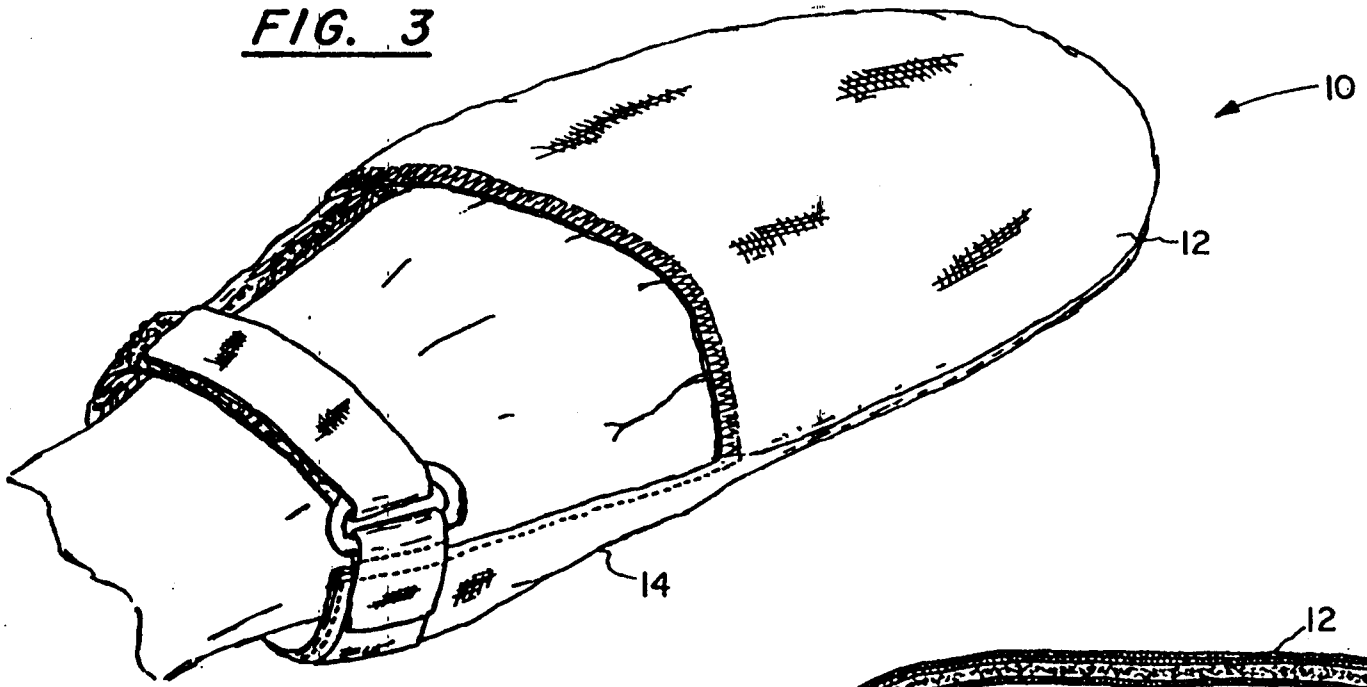
FIG. 3 is a perspective view of the apparatus shown in FIG. 1 and more particularly illustrating the manner of fastening the mitten to the wrist of a user.

Referring now to FIGS. 1–3 there is shown the mitten 10 in accordance with one form of the invention. The mitten 10 includes a top face 12 and a bottom face 14. The top 12 and the bottom face 14 have portions thereof which are substantially identical in shape and size as best seen in FIG. 1. The bottom face 14 will be seen to be somewhat larger than the top face 12 and is dimensioned to extend to the wrist of the user. One such manner of use is shown in FIG. 3. The apparatus in accordance with ther invention may also be used with the top face 12 extending from the tips of the fingers across the fingers and across part of the palm and ordinarily up to the connection of the thumb to the palm of the user. The dimensions of the top face 12 and the back face 14 ordinarily will be chosen such that the user may insert the thumb into the pocket defined between the palm face 12 and the back face 14. The apparatus may also be dimensioned and used so that the pocket defined by the top face 12 and the bottom face 14 accomodates only the two fingers nearest the thumb or the three fingers nearest the thumb and the tip face 12 extends across the palm. It will be understood that the user may alternatively place four fingers inside the pocket and extend a thumb outside of the pocket defined by the top face 12 and the bottom face 14. The lower most, as viewed in FIGS. 1 and 2, extremity of the bottom face (the end most remote from the fingertips) has a strap 16 secured thereto. More specifically, the strap 16 is preferably fixed to the extremity of the back face 14 with a ring 18 at one extremity of the strap 16. The other extremity of the strap 16 has axially adjacent portions which are hook portions 20 and eye portions 22. The hook portions 20 and eye portions 22 will be understood to be of the type which is commonly sold under the VELCRO trademark.

Ordinarily, the top face 12 and the bottom face 14 will both be manufactured of the same material and preferably this will be a soft cotton material such as the material that is commonly used for baby diapers.

Preferably the top face 12 and the bottom face 14 are joined together by sewing and more particularly by providing an inwardly extending seam (not shown) in which peripheral faces of the top face 12 and the bottom face 14 are disposed in face to face abutting relation. In other forms of the invention, the adhesive material may be used to join the front and back faces or other techniques which are known in the art may be utilized to form the mitten.

Ordinarily, the strap 16 will be fixed to the lower, as viewed in FIGS. 1 and 2, portion of the back face 14, although it will be understood that in other forms of the invention, a sleeve or tunnel may be formed in the back face 14 for receiving the strap 16 and allowing axial movement of the strap 16.

As best seen in FIG. 3, the strap 16 allows for adjustablility with respect to accomodate varying sizes of the users wrist. More particularly the hook portion 20 would ordinarily pass through the loop 18 and be secured to the eye portion 22 of the strap 16 so the strap 16 is snug around the wrist of the user. When so secured, it will be understood that the mitten 10 will not tend to fall off the wrist of the user and thus the user may vigorously apply polish or shine a pair of shoes or even other objects with concern for the mitten 10 falling off his hand.

Figure 4:
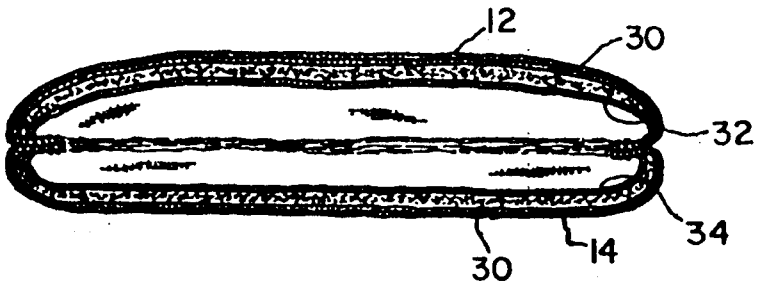
FIG. 4 is longitudinal cross section of a preferred embodiment of the invention that includes an inner layer of non-woven absorbent material in the first web shaped fabric member.

The embodiment of the invention illustrated in FIG. 4 includes a non-woven synthetic material 30 which is particularly absorbent. The material 30 is preferably disposed between the top face 12 and a second layer 32 of soft cotton. This construction is particularly advantageous because the absorbent material 30 will limit the amount of moisture that is present on the top face 12. Similarly, the bottom face 14 is preferably backed by the identical non-woven absorbent material 30 and is retained by layer of soft absorbent cotton material 34. This layer 34 will ordinarily be sewn to the bottom face 14.

In the preferred manner of use, the shoes or object to be polished are cleaned such as by the use of saddle soap to remove dirt from the shoes. Ordinarily a simple cloth will be sufficient for this purpose. Thereafter, the mitten 10 is installed on the hand of the user and dabbed in a container of shoe polish so that there is a small deposit of the shoe polish on the palm face 12 of the mitten 10. This is lightly dabbed on the shoe (not shown) which is to polished and thereafter there is continued rubbing of the leather or other surface to be polished. Although the mitten 10, in accordance with the present invention, is particularly suitable for using the same surface thereof for applying the polish as well a completing the final polishing operations, it will be understood that the mitten 10 may also be used merely to shine the shoe after the polish has been applied to the shoe.

It will best be seen that the apparatus in accordance with the present invention is adaptable to the hands of many different users, and more particularly, to either the left or the right hand of the user. It will be further seen that the apparatus of the present invention will securely be held on the hand of a user even though the user may vigorously polish a shoe or other object, although the invention has particular application to polishing shoes, it will be understood that it may also be utilized for polishing other objects.

It will be seen that the invention will produce a long lasting superior shine while being very convenient to use. In addition, invention provides apparatus which will enable the use to avoid soiling his hands while polishing shoes and that the apparatus is suitable for both applying shoe polish and for for shining the associated shoe.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the appended claims.

Having thus described my invention I claim:

1. A polishing mitten apparataus for polishing a shoe or other associated object which comprises:

a first web shaped fabric member having a portion thereof dimensioned and configured with an outline that is substantially the same as the palm and extended fingers of the intended user, said first web shaped fabric member including a layer of absorbent non-woven fabric;

a second web shaped fabric member having a portion thereof which is substantially the same size and shape as the first web shaped fabric member and further including an extension dimensioned and configured for extending over the wrist of the user; and a strap member fixed to said extenison dimensioned and configured for encircling the wrist of the user.

2. The apparatus as described in claim 1 wherein:

said first web shaped fabric member has a plurality of layers and the outermost layer is cotton material, said outermost layer covering an inner layer which is said non-woven absorbent fabric layer.

3. The apparatus as described in claim 2 wherein:

said first web shaped member further includes another layer of cotton material disposed adjacent to said non-woven fabric layer whereby said non-woven fabric layer has a layer of cotton against each face thereof.

4. The apparatus as described in claim 3 wherein:

said second web shaped fabric member includes a layer of non-woven absorbent fabric material.

5. The apparatus as described in claim 4 wherein:

said second web shaped fabric member has a plurality of layers and the outermost layer is cotton material, said outermost layer covering an inner layer which is said non-woven absorbent fabric layer.

6. The apparatus as described in claim 5 wherein:

said second web shaped member further includes another layer of cotton material disposed adjacent to said non-woven fabric layer whereby said non-woven fabric layer has a layer of cotton against each face thereof.

7. The apparatus as described in claim 6 wherein:

said strap includes first and second axial sections which are respectively cooperating hook and eye portions.

8. The apparatus as described in claim 7 wherein:

said strap has a ring fixed to one axial extremity thereof.

9. The apparatus as described in claim 8 wherein:

said strap member is fixed to said extension intermediate said first axial extremity and said first and second axial sections.

10. The apparatus as described in claim 9 wherein:

said ring is generally D-shaped.

11. The apparatus as described in claim 10 wherein:

said D-shaped ring has one side thereof which is substantially straight and that side is fixed to said first axial extremity of said strap member.

12. A polishing mitten apparatus for polishing a shoe or other associated object which comprises:

a first web shaped fabric member having a portion thereof dimensioned and configured to be substantially the same as the outline of the palm and extended fingers of the intended user, said first web shaped fabric member including a plurality of layers, at least one of said plurality of layers being absorbent non-woven fabric; a second web shaped fabric member having a portion thereof which is substantially the same size and shape as the first web shaped fabric member and further including an extension dimensioned and configured for extending over the wrist of the user; and a strap member fixed to said extension dimensioned and configured for encircling the wrist of the user.

13. The apparatus as described in claim 12 wherein: said first web shaped fabric member has an outermost layer that is cotton material, said outermost layer covering an inner layer which is said non-woven absorbent fabric layer.

14. The apparatus as described in claim 13 wherein: said strap includes first and second axial sections which are respectively cooperating hook and eye portions.

15. The apparatus as described in claim 14 wherein: said strap has a ring fixed to one axial extremity thereof.

16. The apparatus as described in claim 15 wherein: said strap member is fixed to said extension intermediate said first axial extremity and said first and second axial sections.

17. The apparatus as described in claim 16 wherein: said ring is generally D-shaped.

18. The apparatus as described in claim 17 wherein: said D-shaped ring has one side thereof which is substantially straight and that side is fixed to said first axial extremity of said strap member.

* * * * *